US008870246B2

(12) United States Patent
Itami et al.

(10) Patent No.: US 8,870,246 B2
(45) Date of Patent: Oct. 28, 2014

(54) APPARATUS FOR CONTROLLING OPENING/CLOSING BODY

(75) Inventors: Eiji Itami, Chiryu (JP); Takeshi Nishikibe, Anjo (JP)

(73) Assignee: Aisin Seiki Kabushiki Kaisha, Kariya-shi, Aichi (JP)

( * ) Notice: Subject to any disclaimer, the term of this patent is extended or adjusted under 35 U.S.C. 154(b) by 517 days.

(21) Appl. No.: 13/120,301

(22) PCT Filed: Oct. 28, 2009

(86) PCT No.: PCT/JP2009/068505

§ 371 (c)(1),
(2), (4) Date: Mar. 22, 2011

(87) PCT Pub. No.: WO2010/058687

PCT Pub. Date: May 27, 2010

(65) Prior Publication Data

US 2011/0167730 A1 Jul. 14, 2011

(30) Foreign Application Priority Data

Nov. 18, 2008 (JP) ..... 2008-294609

(51) Int. Cl.

| | |
|---|---|
| ***E05C 3/06*** | (2006.01) |
| ***E05B 81/66*** | (2014.01) |
| ***E05B 81/20*** | (2014.01) |
| ***E05B 81/68*** | (2014.01) |
| *E05C 3/00* | (2006.01) |

(52) U.S. Cl.

CPC ..... *E05B 81/20* (2013.01); *E05B 81/66* (2013.01); *E05B 81/68* (2013.01)

USPC ..... 292/201; 292/216

(58) Field of Classification Search

USPC ..... 292/201, 216

See application file for complete search history.

(56) References Cited

U.S. PATENT DOCUMENTS 4,762,348 A * 8/1988 Matsumoto ..... 292/201

(Continued)

FOREIGN PATENT DOCUMENTS

| | | | |
|---|---|---|---|
| CN | 2583293 | Y | 10/2003 |
| CN | 1524732 | A | 9/2004 |
| JP | 2003-120104 | A | 4/2003 |
| JP | 2003-120105 | A | 4/2003 |
| JP | 2005-163357 | A | 6/2005 |

OTHER PUBLICATIONS

Notification of Transmittal of Translation of the International Preliminary Report on Patentability (Form PCT/IB/338) dated Jul. 11, 2011, International Preliminary Report of Patentability (Form PCT/IB/373) and Written Opinion of the International Searching Authority (Form PCT/ISA/237) dated Jun. 21, 2011, issued in corresponding International Patent Application No. PCT/JP2009/068505.

(Continued)

*Primary Examiner* — Carlos Lugo

(74) *Attorney, Agent, or Firm* — Buchanan Ingersoll & Rooney P.C.

(57) ABSTRACT

An apparatus for controlling an opening/closing body for automatically opening/closing the opening/closing body. The apparatus includes a displacement body movable and displaced between movable regions including a closing region, a releasing region and a neutral region, a neutral detecting first switch configured to output a first detection signal in response to passage of the displacement body through a first boundary portion of the neutral region, a neutral detecting second switch configured to output a second detection signal in response to passage of the displacement body through a second boundary portion of the neutral region, and a control unit which, when effecting a neutral returning movement for returning the displacement body from the closing region to the neutral region, stores switchover information indicative of switchover of the first detection signal detected in the course of the latch closing movement and to effect the neutral returning movement in accordance with the switchover information.

4 Claims, 8 Drawing Sheets

(56) References Cited

U.S. PATENT DOCUMENTS

| | | | | |
|---|---|---|---|---|
| 5,520,425 | A * | 5/1996 | Dowling | 292/201 |
| 5,938,251 | A * | 8/1999 | Watanabe | 292/201 |
| 6,065,315 | A * | 5/2000 | Hoshikawa et al. | 70/264 |
| 6,386,599 | B1 * | 5/2002 | Chevalier | 292/201 |
| 6,848,727 | B1 * | 2/2005 | Cetnar et al. | 292/201 |
| 6,964,438 | B2 * | 11/2005 | Koike et al. | 292/201 |
| 6,974,165 | B2 * | 12/2005 | Koike et al. | 292/216 |
| 8,322,761 | B2 | 12/2012 | Itami et al. | |
| 2003/0067175 | A1 | 4/2003 | Shiota et al. | |
| 2004/0223336 | A1 | 11/2004 | Murakami et al. | |
| 2009/0165386 | A1 * | 7/2009 | Suzuki et al. | 49/282 |
| 2010/0270815 | A1 * | 10/2010 | Shinoda et al. | 292/201 |

OTHER PUBLICATIONS

Official Action issued by Chinese Patent Office on Dec. 26, 2012 in Chinese Application No. 200980135084.7, and English language translation of Official Action (16 pages).

International Search Report (PCT/ISA/210) issued on Dec. 8, 2009, by Japanese Patent Office as the International Searching Authority for International Application No. PCT/JP2009/068505.

Written Opinion (PCT/ISA/237) issued on Dec. 8, 2009, by Japanese Patent Office as the International Searching Authority for International Application No. PCT/JP2009/068505.

*Elysion* Service Manual: Construction, Window & Door, Power Tailgate Control System 8-48-8-49, Honda Motor Co., Ltd. issued May 5, 2004.

* cited by examiner (a)

(b)

APPARATUS FOR CONTROLLING OPENING/CLOSING BODY

TECHNICAL FIELD

The present invention relates to an apparatus for controlling an opening/closing body, the apparatus being capable of a latch closing operation for establishing engagement between a latch and a striker, and a latch releasing operation for releasing the engagement between the latch and the striker, with rotational displacement based on a motor operation.

BACKGROUND ART

Conventionally, there is known an automobile door lock operating apparatus for effecting a locking operation with rotation of an actuator output shaft in the forward direction and an unlocking operation with rotation of the actuator output shaft in the reverse direction. There is also known a vehicle door closer apparatus configured such that a latch closing operation is effected in response to displacement in one direction of a driven gear as a displacement body receiving power of a reversibly rotatable motor thereby to pivot a latch for drawing in a striker and a latch releasing operation is effected in response to displacement in the other direction of the driven gear thereby to pivot a pawl for releasing engagement between the latch and the pawl.

This type of apparatuses include a releasing function for releasing engagement between a latch and a striker by displacing a displacement body such as a sector gear receiving motor power in a releasing direction relative to a neutral region and a closing function for causing the latch to draw in the striker by displacing the displacement body in a closing direction relative to the neutral region. In the course of these, if the displacement body is to be displaced to the neutral region by the motor power after execution of the releasing function or the closing function, a neutral detecting means such as a switch is needed for controlling stopping of the motor.

However, if a trouble occurs in this neutral detecting means, there is the risk of the displacement body being moved inadvertently to its displacement terminal end. Namely, in such case, after the execution of a latch closing operation, the displacement body could enter inadvertently into a latch releasing operation rather than being stopped at the neutral region as it should be, as a result of which the door after being once closed may be opened unintentionally. Also, after the execution of a latch releasing operation, the displacement body could enter inadvertently into a latch closing operation rather than being stopped at the neutral region as it should be, as a result of which the door after being once unlocked may be locked unintentionally.

As a technique for overcoming such problem as above, there is known a technique disclosed in a Non-Patent Document 1 identified blow. According to this technique disclosed in the Non-Patent Document 1, the technique controls such that a closer unit is controlled with reference to a neutral position (OFF state of a neutral switch) of a sector gear. Therefore, the control is effected such that a retuning movement of the sector gear to the neutral position is effected at the time of power ON (i.e. power activation).

PRIOR ART DOCUMENT

Non-Patent Document

Non-patent Document 1: *ELYSION* Service Manual: Construction (Window & Door, Power Tailgate Control System 8-48~8-49, Honda Motor Co., Ltd. issued May 5, 2004).

SUMMARY OF THE INVENTION

Problem to be Solved by Invention

However, in the case of the technique disclosed in Non-Patent Document 1 above, the technique does not monitor the condition (normal condition or abnormal condition) of the neutral switch. Therefore, when the sector gear is returned to the neutral position at the time of power-on, the door may be opened inadvertently if a trouble exists in the neutral switch. Further, at the time of power-on, the latch may be released unintendedly, thus rendering the door loose.

The present invention has been made in view of the above-described problem. Its object is to provide an opening/closing body controlling apparatus capable of preventing opening/closing of an opening/closing body against the user's intension.

Means for Accomplishing the Object

For accomplishing the above-noted object, an apparatus for controlling an opening/closing body for automatically opening/closing the opening/closing body, relating to the present invention, the apparatus comprises:

a latch for drawing in and releasing a striker;

a displacement body for operating said latch via a latch operating mechanism, said displacement body being movable and displaced between movable regions including a latch closing region for drawing in said latch, a latch releasing region for releasing said latch and a neutral region located between said latch closing region and said latch releasing region;

a first detecting section configured to output a first detection signal in response to passage of the displacement body through a first boundary portion of the neutral region on the side of the closing region; and a control unit which, when effecting a neutral returning movement for returning the displacement body from the closing region to the neutral region, stores switchover information indicative of switchover of the first detection signal detected in the course of the latch closing movement and to effect the neutral returning movement in accordance with the switchover information.

With the above-described characterizing construction, when the memory of the switchover information was erased due to e.g. reactivation of power, thus rendering the state of the first detection signal indefinite, it is possible to prevent intentionally the neutral returning movement after a latch closing movement from taking place. Therefore, inadvertent releasing movement of the latch can be avoided. Hence, it is possible to prevent inadvertent opening/closing of the opening/closing body against the user's intension.

Preferably, in effecting said neutral returning movement, in the case of presence of power reactivation during a period from the previous neutral returning movement to the current neutral returning movement, said control unit refers to switchover information that was stored at the time of the latch closing movement effected prior to the previous neutral returning movement; whereas in the case of absence of power reactivation during said period from the previous neutral returning movement to the current neutral returning movement, said control unit refers to switchover information that was stored at the time of the latch closing movement effected prior to the current neutral returning movement.

Even when the first detecting section is operating normally, if power reactivation occurred at the time when the displacement body moved from the neutral region to the closing region in the course of a closing movement, it is not possible for the control unit, in its operation subsequent to the power reactivation, to obtain any switchover information of the first detection signal. Therefore, with the above-described construction, in the case of presence (occurrence) of power reactivation at the timing of movement of the displacement body from the neutral region to the closing region in the course of a closing movement, the switchover information of the first detection signal that was stored prior to this power reactivation becomes the previous switchover information, so the neutral returning movement is effected with reference to this switchover information. Hence, it is possible to restrict occurrence of inconvenience of a neutral returning movement being not effected in spite of the first detecting section being operating normally. Also, in the case of absence (no occurrence) of power reactivation, the current switchover information, not the previous switchover information, is referred to. Therefore, it is possible to restrict occurrence of the inconvenience of a neutral returning movement being effected in spite of some abnormality occurring in the first detecting section.

Further, preferably, said displacement body is controlled to pivot said latch toward said pawl that restricts pivotal movement of this latch.

With this construction, when the latch has been pivoted to its mechanical pivotal terminal end, thus having its pivotal movement restricted, the latch will be pivoted toward the opposite mechanical terminal end thereof. As a result, it is possible to avoid the inconvenience of the latch encountering great resistance or difficulty in its next pivotal movement. Consequently, the latch is allowed to be pivoted smoothly.

Preferably, the controlling of the pivotal movement of the displacement body toward the pawl is effected until lapse of a predetermined period that is predetermined to be shorter than a period required for the displacement body to reach the neutral region after start of this controlling or by a predetermined movement amount that is predetermined to be smaller than a movement amount required for the displacement body to reach the neutral region after start of said controlling.

With the above-described construction, even when the latch is pivoted to the mechanical terminal end, the next starting movement of the latch can be effected easily without need to open/close the opening/closing body.

Further, preferably, said opening/closing body controlling apparatus is used as a vehicle opening/closing body controlling apparatus to be mounted on a vehicle, and said control unit is configured not to effect the neutral returning movement according to said switchover information during traveling of the vehicle, even if a condition for effecting the neutral returning movement is established according to said switchover information.

With the above-described construction, it is possible to prevent an opening/closing body provided in a vehicle from being opened/closed inadvertently during traveling of the vehicle against the passenger's intension.

MODE FOR EMBODYING THE INVENTION

Figure 1:
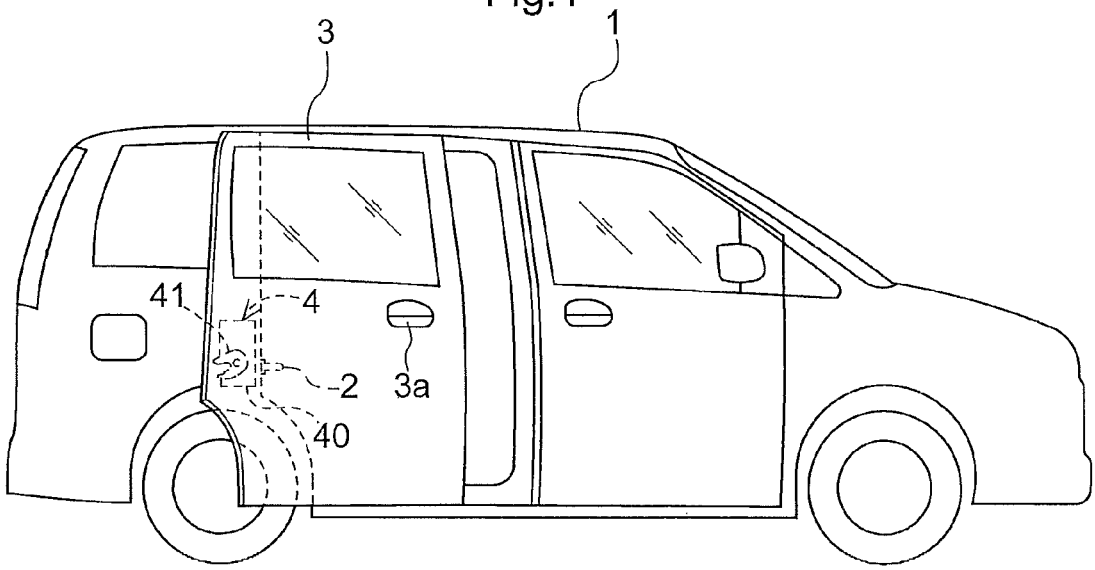
FIG. 1 is a view showing a lateral side of a vehicle mounting an opening/closing body controlling apparatus.

Next, an opening/closing body controlling apparatus 100 relating to the present invention will be described. This opening/closing body controlling apparatus 100 has a function of automatically opening/closing an opening/closing body. In this embodiment, there will be described a case of using the opening/closing body controlling apparatus 100 for opening/closing a slide door 3 of a vehicle, that is, a case of using the apparatus as a vehicle opening/closing body controlling apparatus mounted on a vehicle. Therefore, in the instant embodiment, the slide door 3 provided in a vehicle corresponds to the "opening/closing body" as defined herein. FIG. 1 is a view showing a lateral side of a vehicle mounting the opening/closing body controlling apparatus 100. Further, FIG. 2 is a view schematically showing in enlargement of a striker 2 and a door opening/closing device (door locking device) 4 included in the opening/closing body controlling apparatus 100.

Figure 2:
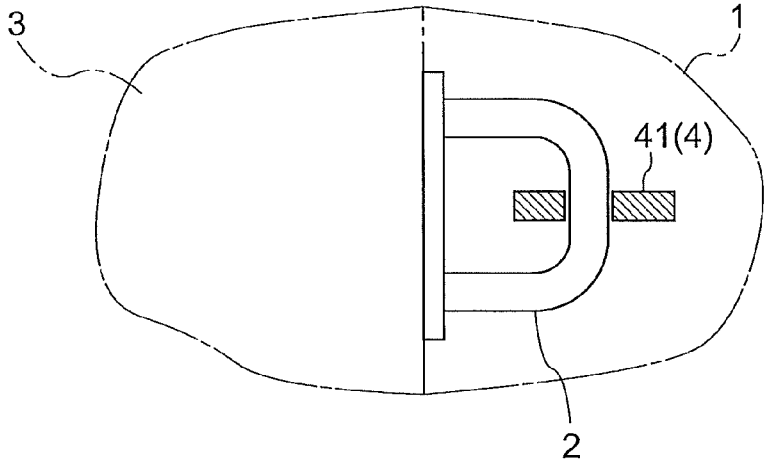
FIG. 2 is a view schematically showing in enlargement of a striker and a door locking device.

FIGS. 1 and 2 show a door opening/closing device 4 disposed between a vehicle body 1 mounting the opening/closing body controlling apparatus 100 and the slide door 3. In the instant embodiment, the door opening/closing device 4 includes a door opening/closing operation mechanism 40 provided on the side of the slide door 3 and the striker 2 provided on the side of the vehicle body 1. This striker 2, as shown in FIG. 1, is disposed on a vehicle rear side of an opening of the vehicle door 1 which is exposed when the slide door 3 is opened. Needless to say, the striker 2 may be disposed on the vehicle front side of the opening. Further, on the outer lateral face of the slide door 3, an opening handle 3*a* is mounted.

Figure 3:
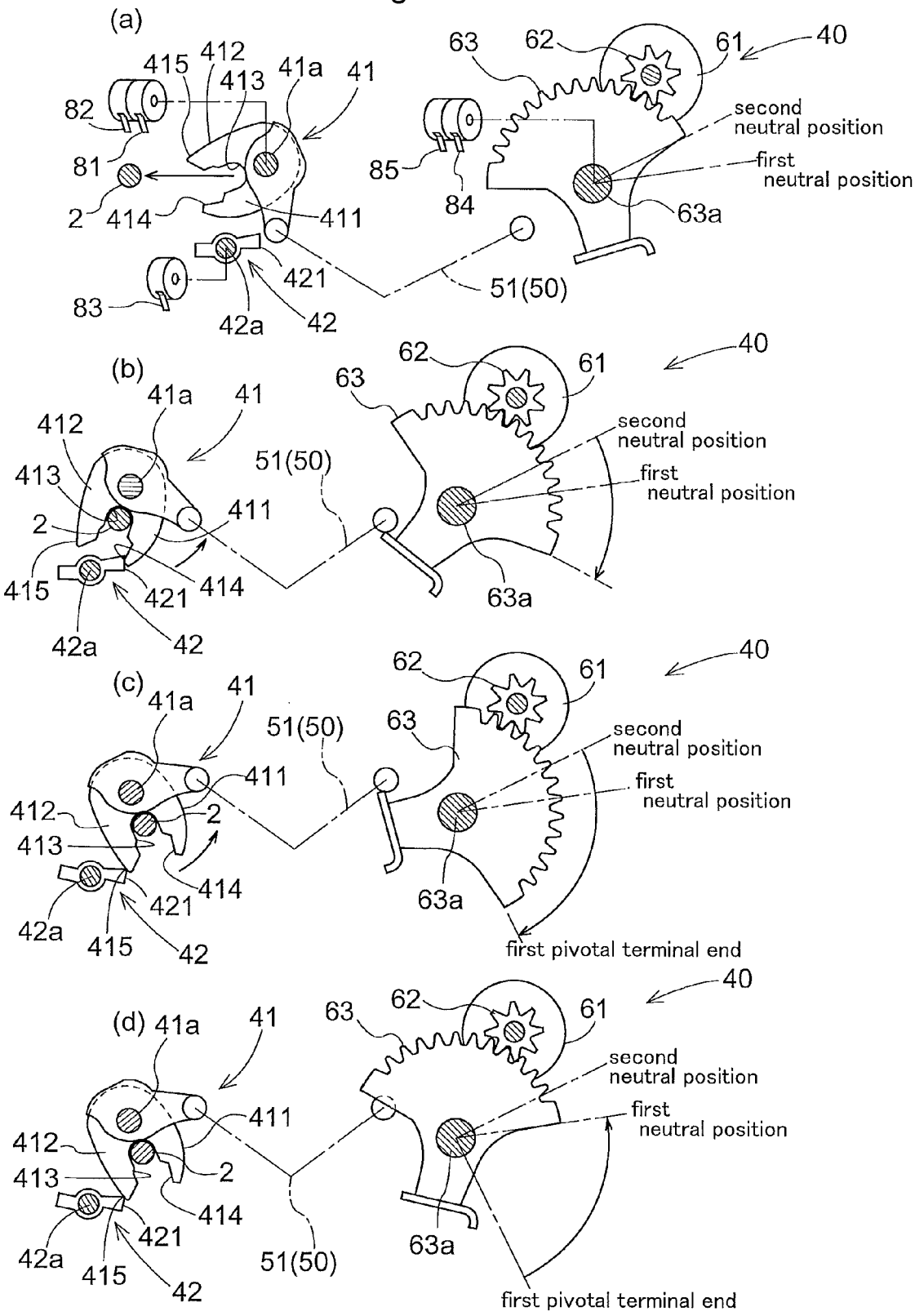
FIG. 3 is a view showing a locked condition of a door opening/closing operation mechanism.
Figure 4:
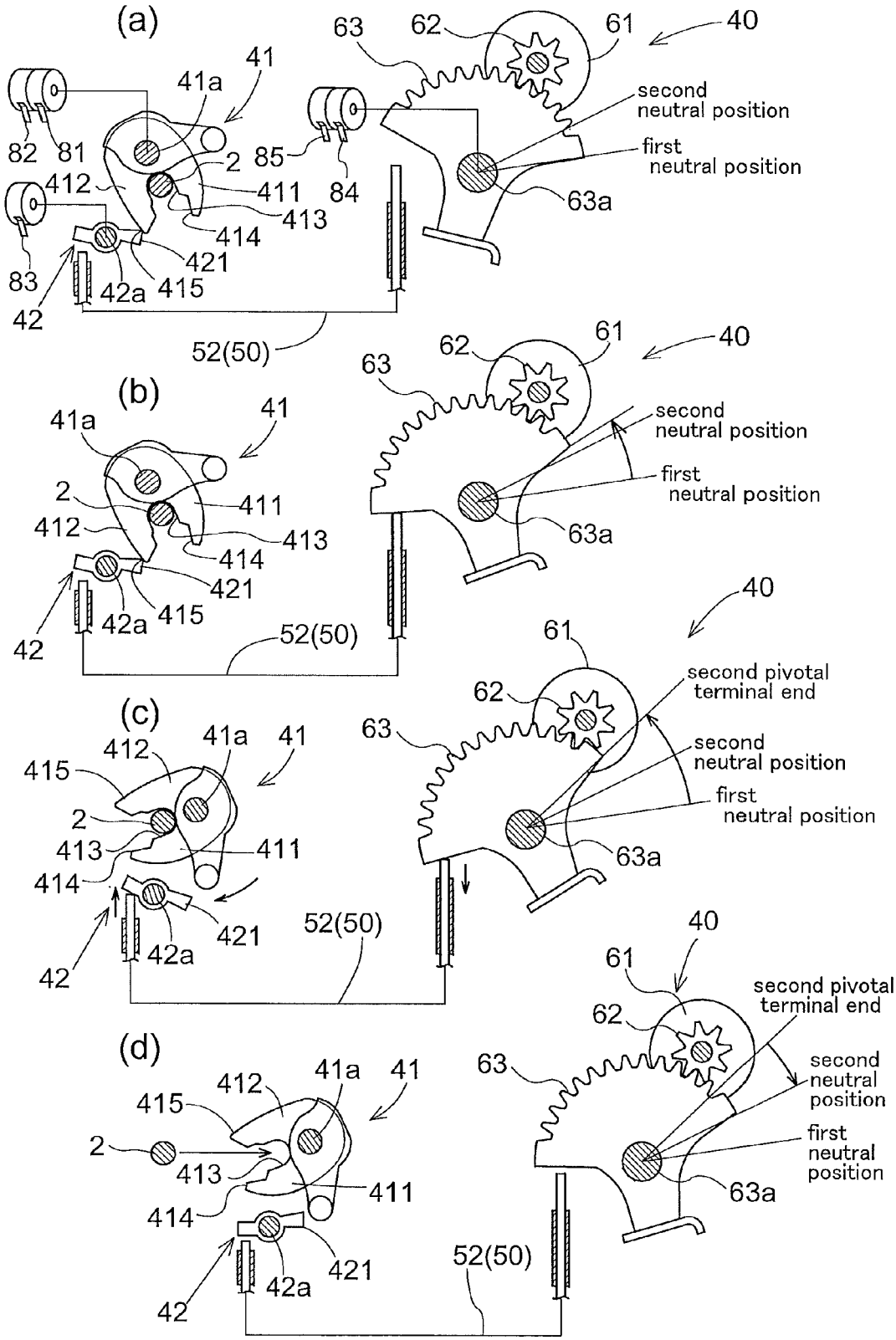
FIG. 4 is a view showing a released condition of the door opening/closing operation mechanism.

The door opening/closing mechanism 40 effects a locking operation and a lock releasing operation of the slide door 3. FIG. 3 is a view showing a locking movement of the door opening/closing operation mechanism 40. FIG. 4 is a view showing a lock releasing movement of the door opening/closing operation mechanism 40. The door opening/closing device 4 includes a latch 41 for effecting drawing-in and releasing of the striker 2, a pawl 42 for restricting pivoting of the latch 41 by the ratchet technique, and a latch operating mechanism 50 for operating the latch 41 and the pawl 42. The latch 41 is comprised of a plate-like member capable of drawing in the striker 2 toward the body of the slide door 3.

In order to provide operating displacements to the latch operating mechanism 50, there are provided a motor 61, a pinion gear 62 acting as a speed changing gear for changing the speed of rotation of the motor 61, and a sector gear (corresponding to the "displacement body" as defined in this invention) 63 for operating the latch 41 via the latch operating mechanism 50. The sector gear 63 is supported to be pivotable about a pivot shaft 63*a* disposed in an unillustrated housing.

Further, as will be detailed later, the sector gear 63 is moved/displaced between movable regions including a closing region for drawing in the latch 41, a releasing region for releasing the latch 41, and a neutral region disposed between the closing region and the releasing region. This movement is realized by rotational power outputted from the motor 61.

The latch 41 is supported to be pivotable about a pivot shaft 41*a* disposed in the unillustrated housing and urged to a returning posture as shown in FIG. 3 (*a*) by means of e.g. a spring (not shown). The latch 41 includes a first arm portion 411 and a second arm portion 412; and between these portions, there is formed an engaging recess 413 capable of receiving the striker 2 therein. The first arm portion 411 includes a half-engaging face 414 engageable with a contact acting portion 421 of the pawl 42 at a half latch position. Further, the second arm portion 412 includes a full engaging face 415 engageable with the contact acting portion 421 of the pawl 42 at a full latch position.

The pawl 42 is supported to be pivotable about a pivot shaft 42*a* between an engaging posture and a releasing posture. Further, the pawl 42 is disposed such that under the above engaging posture and releasing posture, the contact acting portion 421 thereof is located within the pivotal path of the first arm portion 411 or the second arm portion 412 of the latch 41. Further, the pawl 42 is urged to return to the engaging posture by means of e.g. a spring (not shown).

Figure 5:
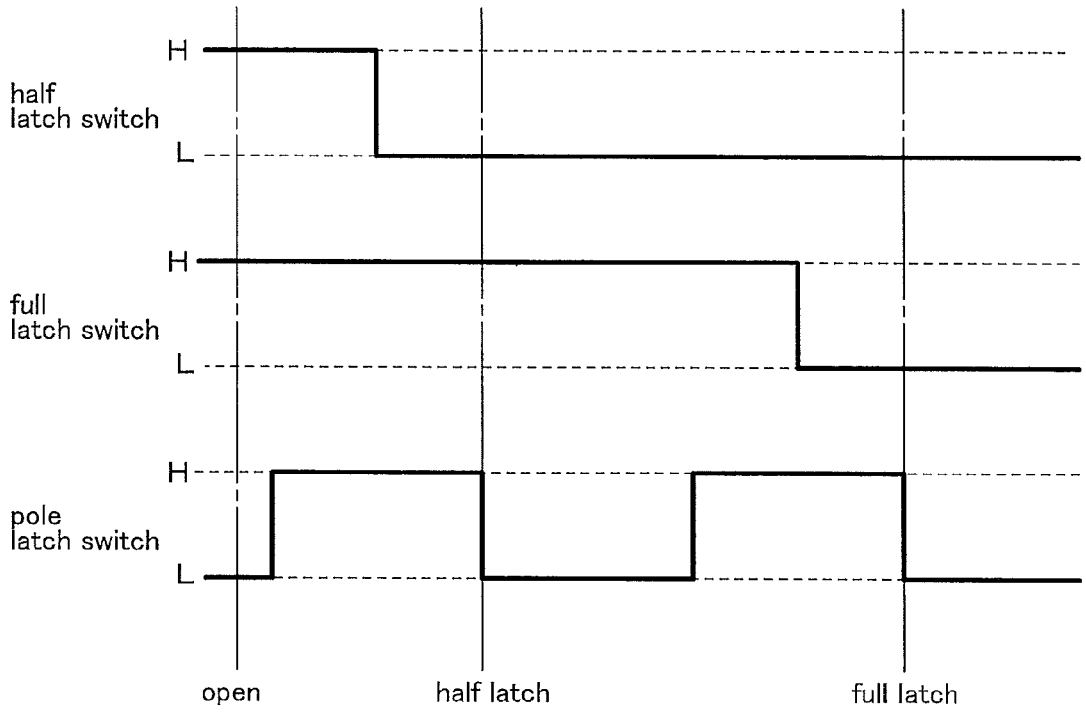
FIG. 5 is a view showing switching of outputs from respective switches.

As position detectors for detecting pivotal positions of the latch 41, a half latch switch 81 and a full latch switch 82 in the form of rotary switches are provided on a detection-target cylinder pivotable about the pivot shaft 41*a* together with the latch 41. The half latch switch 81 detects presence of the latch 41 in the half latch region. The full latch switch 82 detects presence of the latch 41 in the full latch region. Incidentally, in the instant embodiment, as illustrated in FIG. 5, the half latch switch 81 is configured to be switched over from "High" (ON) to "Low" (OFF) when the latch 41 has moved from the opening position to a position before the half latch position. Similarly, the full latch switch 82 is configured to be switched over from "High" (ON) to "Low" (OFF) when the latch 41 has moved from the half latch position to a position before the full latch position.

Referring back to FIG. 3, as a position detector for detecting the pivotal position of the pawl 42, a pawl switch 83 in the form of a rotary switch is provided on a detection-target cylinder pivotable about the pivot shaft 42*a* together with the pawl 42. The pawl switch 83 detects the pawl 42 being under a posture engaged with the latch 41. In this embodiment, the pawl switch 83, as illustrated in FIG. 5, is turned "High" (ON) when the pawl 42 is located in the region before and including the half clutch position engaged with the first arm portion 411 of the latch 41. Further, the pawl switch 83 is turned "High" (ON) when the pawl 42 is located in the region before and including the full clutch position engaged with the second arm portion 412 of the latch 41. That is, in the closing movement of the slide door 3, the first falling point of the pawl switch 83 corresponds to the half latch position and the second falling point thereof corresponds to the full latch position, respectively.

The latch operating mechanism 50 includes a latch closing operation mechanism 51 (see FIG. 3) and a latch releasing operation mechanism 52 (see FIG. 4). The latch closing operation mechanism 51 inputs a pivotal displacement of the sector gear 63 and outputs a pivotal operational force for the latch 41. The latch releasing operation mechanism 52 inputs a pivotal displacement of the sector gear 63 and outputs a pivotal operational force (engagement releasing operation) for the pawl 42. The closing region as the pivotal region of the sector gear 63 in which the latch closing operation mechanism 51 is effective and the releasing region as the pivotal region of the sector gear 63 in which the latch releasing operation mechanism 52 is effective are distinct from each other across a neutral region (the details thereof will be described later). Therefore, the latch closing operation mechanism 51 and the latch releasing operation mechanism 52 function distinctly from each other.

A detection-target cylinder pivotable together with the sector gear 63 about its pivotal shaft 63*a* mounts a neutral detecting first switch 84 as a "first detecting section" and a neutral detecting second switch 85 as a "second detecting section" in the form of rotary switches for detecting pivotal displacement postures of the sector gear 63.

Figure 6:
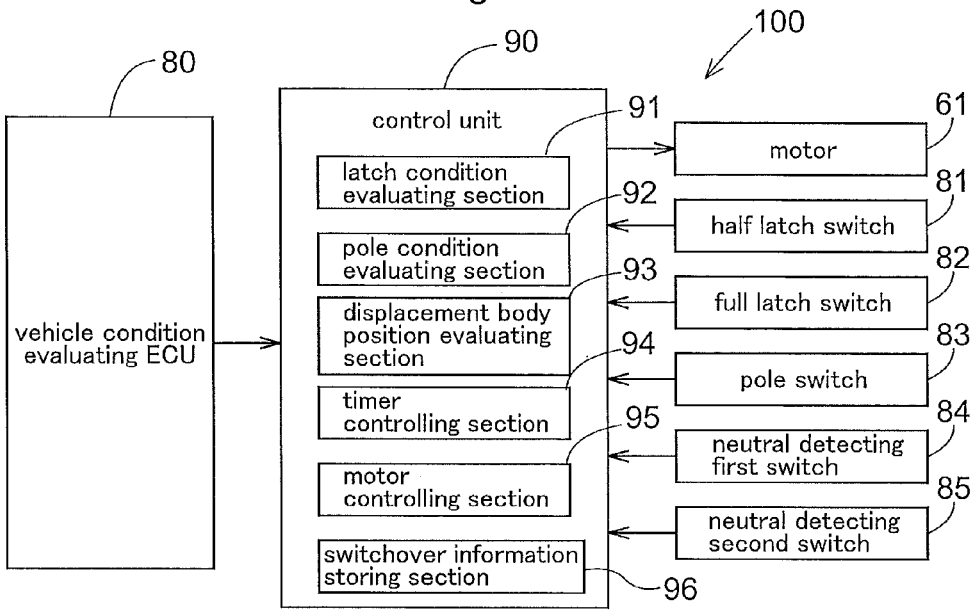
FIG. 6 is a block diagram schematically showing a general construction of a control unit.

FIG. 6 is a block diagram schematically showing a general construction of a control unit 90 for controlling the door opening/closing operation mechanism 40. To input portions of the control unit 90, there are connected the half clutch switch 81, the full latch switch 82, the pawl switch 83, a neutral detecting first switch 84 and a neutral detecting second switch 85. And, to an output port of the control unit 90, the motor 61 is connected via an unillustrated driver. Further, this control unit 90 is connected also to a vehicle condition evaluating ECU 80 for evaluating condition of the vehicle and outputting vehicle condition information, so that the control unit 90 can obtain vehicle condition information relating to opening/closing of the slide door 3.

The control unit 90 is composed of a latch condition evaluating section 91, a pawl condition evaluating section 92, a displacement body position evaluating section 93, a timer controlling section 94, a motor controlling section 95, and a switchover information storing section 96. And, in this control unit 90, the above-described functional sections thereof for effecting various operations for opening/closing the slide door 3 are comprised of hardware and/or software, with a CPU as the core component thereof.

The latch condition evaluating section 91 evaluates the condition of the latch 41 based on the signals from the half latch switch 81 and the full latch switch 82. The pawl condition evaluating section 92 evaluates the condition of the pawl 42 based on the signal from the pawl switch 83. The displacement body position evaluating section 93 evaluates the pivotal position of the sector gear 63 based on the first detection signal from the neutral detecting first switch 84 and the second detection signal from the neutral detecting second switch 85. The timer controlling section 94 effects timer control with using an internal timer or the like. The motor controlling section 95 generates and output control signals for the motor 61, based on the results of evaluations by the latch condition evaluating section 91, the pawl condition evaluating section 92 and the displacement body position evaluating section 93, and on the timer information from the timer controlling section 94. Though will be described in details later, the switchover information storing section 96 stores switchover information indicative of switchover of the first detection signal which was detected in the course of a closing movement of the sector gear 63.

Figure 7:
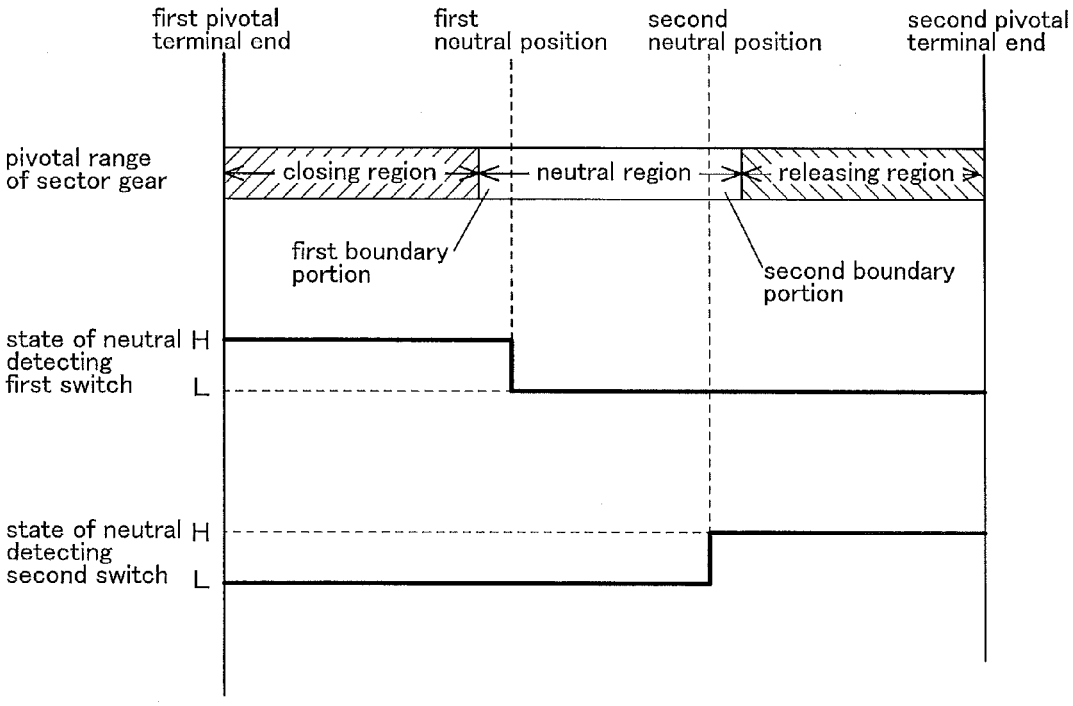
FIG. 7 is a view showing pivotal regions of a sector gear relating to a latch closing movement.
Figure 8:
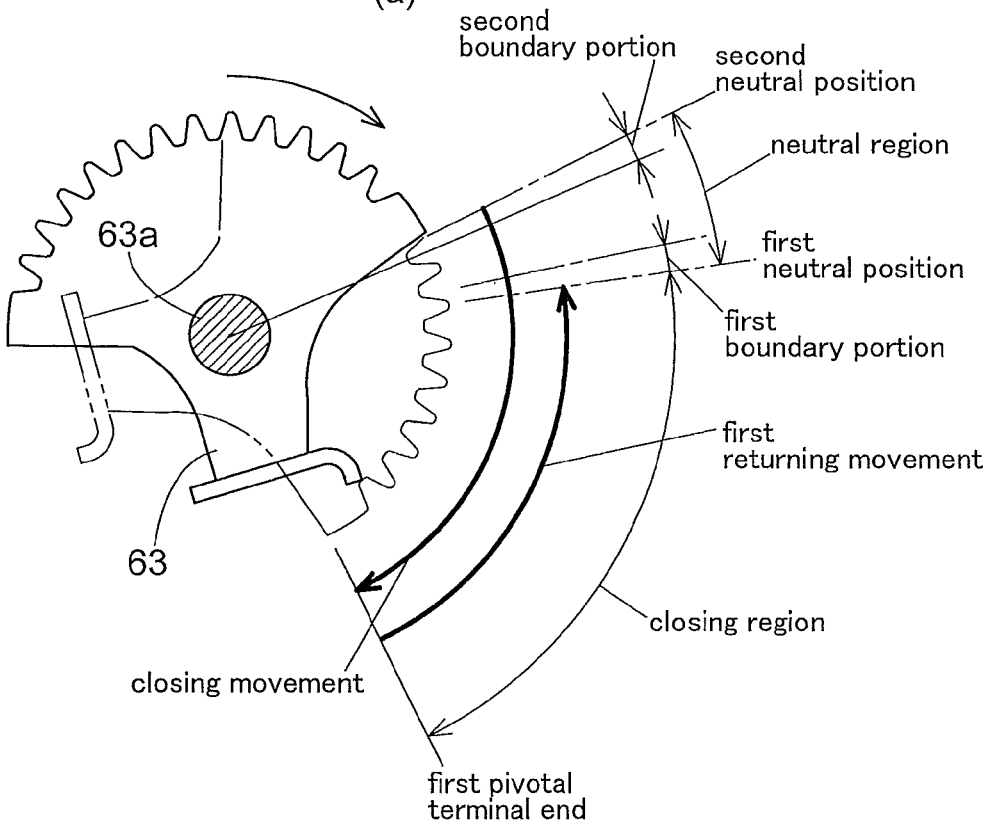
FIG. 8 is a view showing pivotal regions of the sector gear relating to a latch releasing movement.
Figure 8:
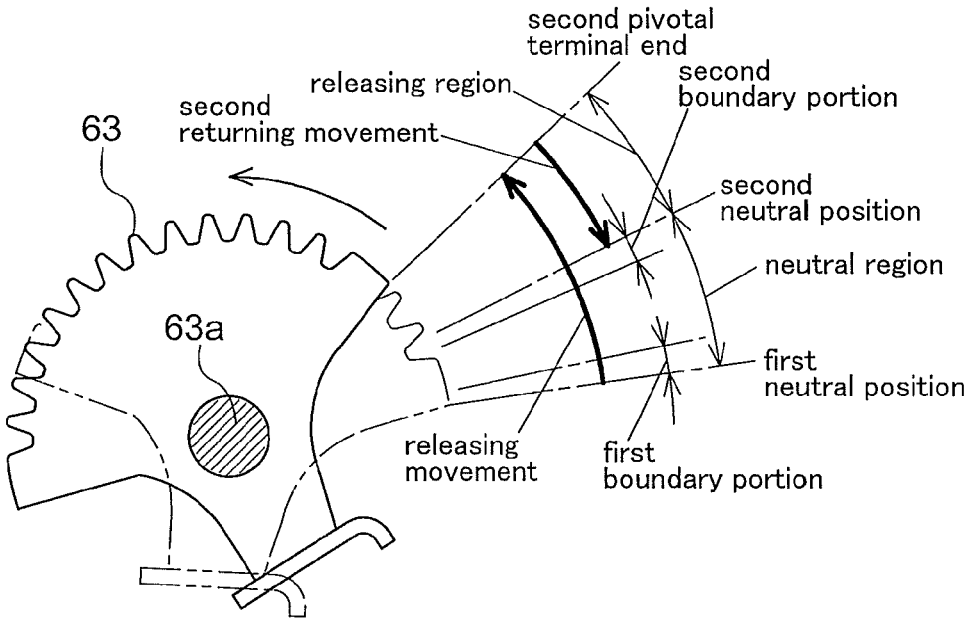

The latch closing movement for drawing the striker 2 into the latch 41 is effected by operating the latch closing operation mechanism 51 through the sector gear 63. And, the latch releasing movement for releasing the striker 2 from the latch 41 is effected by operating the latch releasing operation mechanism 52 through the sector gear 63. The pivotal regions of the sector gear 63 for providing the latch closing movement and the latch releasing movement are sectioned from each other such that the closing region and the releasing region are provided across the neutral region therebetween as illustrated in FIG. 7 and FIG. 8. Further, at the closing side boundary portion of the neutral region, there is set a first boundary portion having a predetermined pivotal width, whereas at the releasing side boundary portion of the neutral region, there is set a second boundary portion having a predetermined pivotal width. And, the neutral region side borderline of the first boundary portion is set as a "first neutral position" and the neutral region side borderline of the second boundary portion is set as a "second neutral position", respectively.

As the sector gear 63 is pivoted in the closing region toward the first pivotal terminal end which is the closing region side pivotal terminal end (counter-clockwise pivotal movement in FIG. 8), a latch closing movement is provided (see FIG. 8 (*a*)). And, after the latch closing movement of the sector gear 63 (upon completion of the latch closing movement), there is effected a first returning movement (neutral returning movement) for returning the sector gear 63 from the closing region to the neutral region. In this first returning movement, the sector gear 63 is pivoted in reverse (clockwise pivotal movement in FIG. 8) to pass through the closing region to enter the neutral region and to stop eventually at the first neutral position.

Further, as the sector gear 63 is pivoted in the releasing region toward the second pivotal terminal end (clockwise pivotal movement in FIG. 8), a latch releasing movement is provided (see FIG. 8 (*b*)). And, after the latch releasing movement of the sector gear 63 (upon completion of the latch releasing movement), there is effected a second returning movement (neutral returning movement) for returning the sector gear 63 from the releasing region to the neutral region. In this second returning movement, the sector gear 63 is pivoted in reverse (counter-clockwise pivotal movement in FIG. 8) to pass through the releasing region to enter the neutral region and to stop eventually at the second neutral position.

The above-described neutral detecting first switch 84 includes an electrode face formed in the peripheral face of the detection-target cylinder rotatable together with the sector gear 63 and a brush coming into contact with this electrode face over a predetermined pivotal area of the sector gear 63. The electrode face of the neutral detecting first switch 84 is disposed so as to come into contact with the brush when the pivotal position of the sector gear 63 is located in the closing region or the first boundary portion. Accordingly, this neutral detecting first switch 84 outputs the first detection signal when the sector gear 63 has passed through the closing region side first boundary region in the neutral region. More particularly, as shown in FIG. 7, the neutral detecting first switch 84 outputs, as the first detection signal, a High signal when the pivotal position of the sector gear 63 is in the closing region or the first boundary portion and outputs a Low signal otherwise, i.e. when the sector gear 63 is at the other pivotal positions.

The neutral detecting second switch 85 too has a similar construction to the neutral detecting first switch 84. However, its electrode face is disposed so as to come into contact with the brush when the pivotal position of the sector gear 63 is located in the releasing region or the second boundary region. Accordingly, this neutral detecting second switch 85 outputs the second detection signal when the sector gear 63 has passed through the releasing region side second boundary region in the neutral region. More particularly, as shown in FIG. 7, the neutral detecting second switch 85 outputs, as the second detection signal, a High signal when the pivotal position of the sector gear 63 is in the releasing region or the second boundary portion and outputs a Low signal otherwise, i.e. when the sector gear 63 is at the other pivotal positions.

Referring now back to FIG. 3 and FIG. 4, the conditions of the sector gear 63, the latch 41 and the pawl 42 in the latch closing operation and latch releasing operation will be described. FIGS. 3 (*a*) through (*d*) schematically show various phases of a latch closing movement and a neutral returning movement subsequent thereto. FIGS. 4 (*a*) through (*d*) schematically show various phases of a latch releasing movement and a neutral returning movement subsequent thereto.

A latch closing movement is effected when the slide door 3 currently opened relative to the vehicle body 1 is to be closed. When the slide door 3 is under the opened state, the pivotal position of the sector gear 63 becomes the second neutral position shown in FIG. 3 (*a*) by the neutral returning movement accompanying the latch releasing movement. When the slide door 3 under the opened state is moved in the closing direction, the door opening/closing operation mechanism 40 provided on the slide door 3 side approaches the striker 2 fixed to the vehicle body 1. Then, the engaging recess 413 of the latch 41 in the door opening/closing operation mechanism 40 receives the striker 2 therein.

When the slide door 3 is further moved, as shown in FIG. 3 (*b*), the contact acting portion 421 of the pawl 42 comes into engagement with the first arm portion 411 of the latch 41 (half latch position). Slightly before arrival of the latch 41 at the half latch position, the motor 61 is driven in the forward direction and the sector gear 63 is pivoted. In association with this pivotal movement of the sector gear 63, in cooperation with the latch closing operation mechanism 51, the latch 41 starts pivoting by the motor power. Incidentally, in this stage, the slide door 3 is not yet completely closed relative to the vehicle body 1.

When the sector gear 63 is further pivoted to the terminal pivotal position of the closing region, as shown in FIG. 3 (*c*), the contact acting portion 421 of the pawl 42 comes into engagement with the second arm portion 412 of the latch 41 (full latch position). In this stage, the slide door 3 is completely closed relative to the vehicle door 1.

Upon completion of the latch closing movement, for the neutral returning movement of the sector gear 63, the motor 61 is driven in reverse. As shown in FIG. 3 (*d*), the pivotal position of the sector gear 63 reaches the first neutral position, whereby the signal of the neutral detecting first switch 84 changes from High (ON) to Low (OFF). In response to this, the sector gear 63 is stopped at this position. In this way, the door opening/closing operation mechanism 40 effects a closing operation of the slide door 3.

A latch releasing movement is effected when the slide door 3 currently closed relative to the vehicle body 1 is to be opened. When the slide door 3 is under the closed state, the pivotal position of the sector gear 63 becomes the first neutral position shown in FIG. 4 (*a*) by the neutral returning movement accompanying the previously effected latch closing movement. When the motor 61 is driven in reverse in response to an operation of e.g. an unillustrated switch provided in the opening handle 3*a* of the slide door 3, the sector gear 63 is pivoted in the direction for the releasing region.

When the sector gear 63 is pivoted, in cooperation with the latch releasing operation mechanism 52, the pawl 42 begins to pivot in the engagement releasing direction. As shown in FIG. 4 (*c*), when the contact acting portion 421 of the pawl 42 is moved away from the latch 41, under the urging force of the spring, the pawl 42 returns to the home position as the releasing posture. And, the latch 41 too is returned to the posture for releasing the striker 2, under the spring urging force. In this stage, it becomes possible to open the slide door 3 relative to the vehicle body 1.

Upon completion of the latch releasing movement, by the neutral returning movement of the sector gear 63, the motor 61 is driven forwardly. As shown in FIG. 4 (*d*), when the pivotal position of the sector gear 63 reaches the second neutral position and the signal of the neutral detecting second switch 85 changes from High (ON) to Low (OFF), the sector gear 63 is stopped at this position. In this way, the door opening/closing operation mechanism 40 effects an opening operation of the door 3.

Here, with the inventive opening/closing body controlling apparatus 100, upon completion of the closing movement of the slide door 3, the first returning movement of the sector gear 63 is effected. In this first returning movement, when the sector gear 63 is pivoted in reverse and passes through the closing region to enter the neutral region, the sector gear 63 is stopped at the first neutral position. Detection of this first neutral position is effected, based on change of the signal of the neutral detecting first switch 84 from High (ON) to Low (OFF).

However, if such change of the signal of the neutral detecting first switch 84 from High (ON) to Low (OFF) cannot be detected due to e.g. some abnormality in the neutral detecting first switch 84, there is the possibility of the sector gear 63 passing through the neutral region to enter the releasing region inadvertently. In such case, the opening/closing body controlling apparatus 100 may erroneously proceed to effect releasing of the latch 41 without confirming whether the sector gear 63 is present in the neutral region or not. In such case, an opening operation of the slide door 3 may be effected erroneously. For this reason, in the case of the inventive opening/closing body controlling apparatus 100, before effecting the first returning movement of the sector gear 63, the apparatus 100 checks whether the first detection signal of the neutral detecting first switch 84 was detected in the course of the closing movement effected prior to this first retuning movement or not. And, based on the result of this determination, the apparatus decides whether to effect the first retuning movement or not. Here, the "closing movement prior to the first returning movement" means the first returning movement effected in operative association with a closing movement.

The switchover information storing section 96 included in the opening/closing body controlling apparatus 100 of the invention stores the switchover information indicative of such switchover of the first detection signal when such switchover was detected. The switchover of the first detection signal refers to a switchover detected in response to movement of the sector gear 63 from the neutral region to the closing region. Therefore, the switchover information to be stored in the switchover information storing section 96 comprises information indicative of occurrence of switchover from Low (OFF) to High (ON) of the first detection signal of the neutral detecting first switch 84. Hence, the switchover information storing section 96 monitors the edge of the change from Low (OFF) to High (ON) of the first detection signal. And, when such edge is detected, this is stored in the switchover information storing section 96. More particularly, the switchover information is stored by the so-called first-in-first-out method. Further, this switchover information stores not only occurrence from Low (OFF) to High (ON) of the first detection signal, but also the time stamp of this occurrence of switchover. That is, the time information of the time when the switchover from Low (OFF) to High (ON) of the first detection signal occurred is stored as well. Therefore, based on the switchover information, the opening/closing body controlling apparatus 100 can readily identify when the switchover of the first detection signal occurred.

In the above, preferably, the switchover information storing section 96 is configured to store only result of most recent detection during power energization, that is, while the power is ON. In such case, if the switchover information storing section 96 currently is storing detection result therein, the control unit 90 can recognize occurrence of shifting of the sector gear 63 from the neutral region to the closing region during power energization. On the other hand, if the switchover information storing section 96 is not currently storing any detection result therein, the control unit 90 can recognize no occurrence of shifting of the sector gear 63 from the neutral region to the closing region during power energization.

In effecting a neutral returning movement, the control unit 90 effects this neutral returning movement, in accordance with switchover information indicative of switchover of the first detection signal that was detected in the course of the closing movement. Here, the switchover information is stored in the switchover information storing section 96 in the manner described above. And, in effecting this neutral returning movement, in the case of presence (occurrence) of power reactivation during a period from the previous neutral returning movement to the current neutral returning movement, the control unit 90 refers to switchover information that was stored at the time of the latch closing movement effected prior to the previous neutral returning movement; whereas in the case of absence (no occurrence) of power reactivation during the above period from the previous neutral returning movement to the current neutral returning movement, the control unit 90 refers to switchover information that was stored at the time of the latch closing movement effected prior to the current neutral returning movement. Incidentally, the language "previous neutral returning movement" refers to a neutral returning movement that has been or was effected prior to the neutral retuning movement to be effected now ("current neutral returning movement").

Therefore, when effecting a neutral returning movement, in case there occurred power reactivation during the period from the previous neutral returning movement to the current neutral returning movement, the control unit 90 effects the neutral returning movement with using or with reference to the switchover information indicative of switchover of the first detection signal detected in the course of a closing movement prior to the current returning movement. That is, even when the neutral detecting first switch 84 is operating normally, if there occurred power reactivation at the time when the sector gear 63 moved from the neutral region to the closing region in the course of a latch closing movement, the control unit 90 cannot obtain switchover information of the first detection signal in the process subsequent to the power reactivation. In this case of occurrence of power reactivation at the time when the sector gear 63 moved from the neutral region to the closing region in the course of a latch closing movement, the switchover information of the first detecting signal stored prior to this power reactivation becomes the previous switchover information. Therefore, a neutral returning movement is effected with reference to this switchover information. Accordingly, it is possible to restrict inconvenience of a neutral returning movement being not effected in spite of the neutral detecting first switch 84 being operated normally.

On the other hand, in the case of absence (no occurrence) of power reactivation during the period from the previous neutral returning movement to the current neutral returning movement, a neutral returning movement is effected with using the switchover information indicative of switchover of the first detection signal that was detected in the latch closing movement prior to the current neutral returning movement. Therefore, in the case of absence of power reactivation, the current switchover information is referred to. Hence, it is possible to restrict occurrence of inconvenience of a neutral returning movement being effected with using switchover information under the condition of abnormality being present in the neutral detecting first switch 84.

In this way, the control unit 90 effects a neutral returning movement with using the switchover information capable of reliably identifying that the sector gear 63 has moved from the neutral region to the closing region. Therefore, even when the state of the first detection signal is indefinite due to e.g. erasing of the switchover information resulting from power reactivation or the like, or failure to store the switchover information due to e.g. abnormality in the neutral detecting first switch 84, the neutral returning movement can be effected appropriately. Therefore, it is possible to prevent opening/closing of the slide door 3 against the user's intension due to inadvertent releasing of the latch.

In the above, the switchover information storing section 96 is configured to erase detection result stored so far, if power supply is stopped longer than a predetermined period (e.g. 2 to 3 seconds). Therefore, if power supply to the switchover information storing section 96 is stopped due to replacement of the battery or the like, detection result stored in the switchover information storing section 96 is erased. Further, as described above, the switchover information may not be stored due to a certain circumstance. Therefore, in such case, the control unit 9 cannot identify when the sector gear 63 moved from the neutral region to the closing region.

Also, in case the switchover information storing section 96 does not store any switchover information stored in the course of a closing movement prior to the neutral returning movement to be currently effected, the control unit 90 controls the latch 41 to be pivoted toward the pawl 42 which restricts pivotal movement of this latch 41. More particularly, when the switchover information storing section 96 does not store any switchover information stored in the course of a closing movement prior to the neutral returning movement to be currently effected, the control unit 90 cannot identify when the sector gear 63 moved from the neutral region to the closing region.

Figure 9:
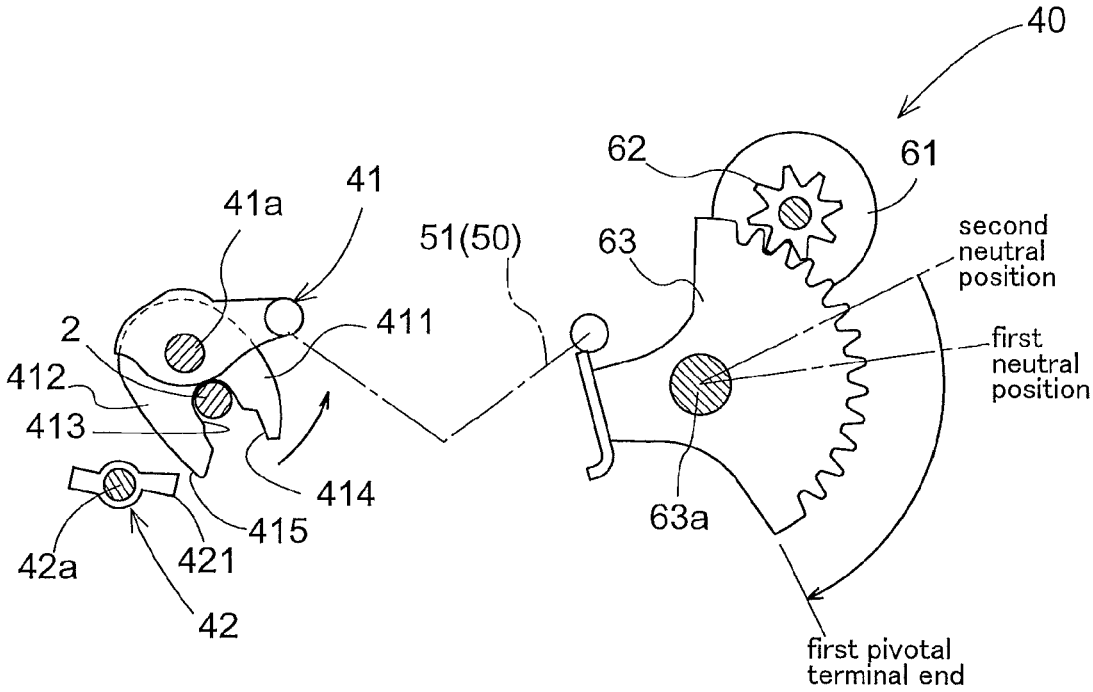
FIG. 9 is a view showing a condition of the door opening/closing operation mechanism in case the latch has drawn in the striker excessively.

Further, in addition to the above-described case, it may be that the pivotal movement of the latch 41 is currently being restricted since the latch 41 was pivoted to its mechanical terminal end due to more than necessary pivotal movement of the latch 41 that occurred when the slide door 3 was to be closed. In such case, as shown in FIG. 9, the latch 41 may draw in the striker 2 excessively, such that a gap may be formed between the contact acting portion 421 of the pawl 42 and the full engaging face 415. In this case, when the user tries to open the slide door 3 manually, the door cannot be opened easily. For this reason, the control unit 90 effects controlling to alleviate the stress applied to the latch 41 by pivoting the latch 41 into contact with the pawl 42. In this invention, such movement or operation to bring the latch 41 into contact with the pawl 42 restricting pivotal movement of the latch 41 is referred to as "a stress alleviating movement".

Such stress alleviating movement effective as controlling for pivoting the sector gear 63 toward the pawl 42 side is effected until lapse of a predetermined period that is predetermined to be shorter than a period required for the sector gear 63 to reach the neutral region after start of this controlling or by a predetermined movement amount that is predetermined to be smaller than a movement amount required for the sector gear 63 to reach the neutral region after start of this controlling. By effecting such controlling as above, even when the latch 41 is pivoted to the mechanical terminal end, thus having its pivotal movement restricted, by pivoting the latch 41 in the opposite direction to the mechanical terminal end, the difficulty or great resistance in the next pivotal movement can be avoided. Thus, pivoting of the latch can be effected easily.

Figure 10:
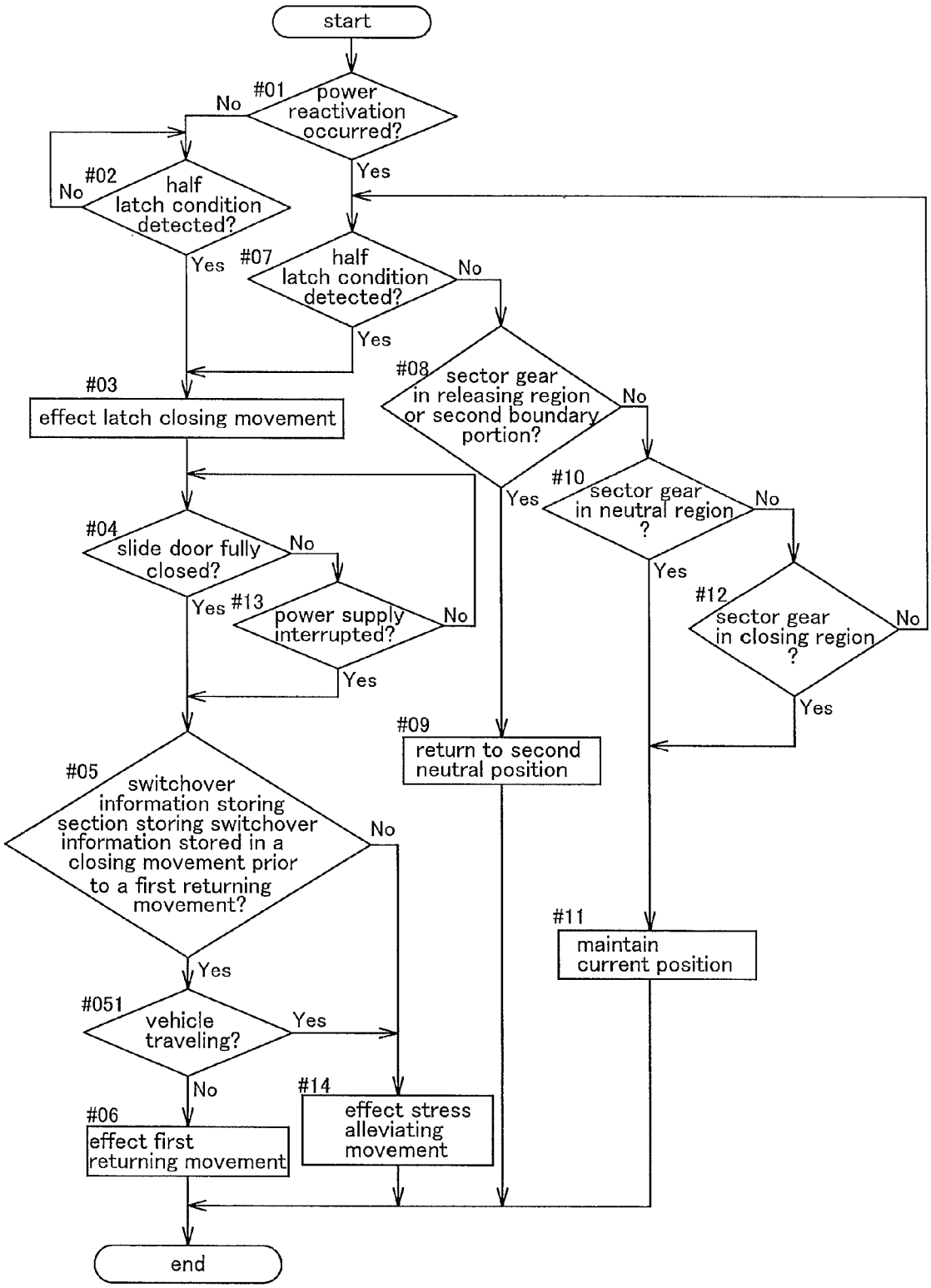
FIG. 10 is a flowchart of a process effected by the opening/closing body controlling apparatus.

Next, the operations carried out by the inventive opening/closing body controlling apparatus 100 will be explained with reference to flowcharts. FIG. 10 is a flowchart of the latch closing movement. The operations carried out by the inventive opening/closing body controlling apparatus 100 vary, depending on presence/absence (occurrence/no occurrence) of power reactivation. Therefore, the process first checks whether power reactivation occurred or not. The language "power reactivation" means that the originally present power supply was once stopped and then the supply has been resumed.

In the case of absence of such power reactivation (step #01: No), for closing the slide door 3, the striker 2 enters the engaging recess 413 of the latch 41 and the latch 41 is pivoted. Further, as the latch 41 is pivoted and the half latch switch 81 is switched over from High (ON) to Low (OFF) and the half latch condition is detected (step #02: Yes), the latch closing movement is started with forward driving of the motor 61 (step #03). This latch closing movement is continued until the latch 41 draws in the striker 2 completely and reaches the full latch position. On the other hand, if the half latch condition is not detected (step #02: No), the process is suspended until detection of half latch condition.

When the latch 41 has completely drawn in the striker 2, thus assuming the full latch position and the slide door 3 is under its fully closed state (step #04: Yes), the motor 61 is stopped. Then, the control unit 90 checks whether the information stored in the switchover information storing section 96 has resulted from a first returning movement to be currently effected or not. In the case of presence of power reactivation during the period from the previous neutral returning movement to the current neutral returning movement, if the switchover information storing section 96 is storing switchover information that was stored at the time of the closing movement resulting in and prior to the previous neutral returning movement (step #05: Yes), or in the case of absence of power reactivation during the period from the previous neutral returning movement to the current neutral returning movement, if the switchover information storing section 96 is storing switchover information that was stored at the time of the closing movement resulting in and prior to the current neutral returning movement (step #05: Yes), the traveling condition of the vehicle is checked. If it is found that the vehicle is not currently traveling, that is, the vehicle is now stopped (step #051: No), the control unit 90 effects a first neutral returning movement (step #06). That is, the control unit 90 closes the sector gear 63 and then returns the sector gear 63 from the closing region to the neutral region, thus completing the process.

On the other hand, at step #05, if it is found that power reactivation took place during the period from the previous neutral returning movement to the current neutral returning movement AND if the switchover information storing section 96 is not storing switchover information that was stored at the time of the closing movement resulting in and prior to the previous neutral returning movement (step #05: No), or if it is found that no power reactivation took place during the period from the previous neutral returning movement to the current neutral returning movement AND if the switchover information storing section 96 is not storing switchover information that was stored at the time of the closing movement resulting in and prior to the current neutral returning movement (step #05: No), then the control unit 90 effects a stress alleviating movement (step #14).

This stress alleviating movement is effected until lapse of a predetermined period that is predetermined to be shorter than a period required for the sector gear 63 to reach the neutral region after start of this controlling or by a predetermined movement amount that is predetermined to be smaller than a movement amount required for the sector gear 63 to reach the neutral region after start of said controlling.

On the other hand, at step #051, if it is found that the vehicle is now traveling (step #051: Yes), the process continues the operation from step #14. In this way, based on the switchover information, the control unit 90 is configured not to effect the neutral returning movement if the vehicle is now traveling, even when the condition for effecting the neutral returning movement is established. With this arrangement, it is possible to prevent opening of the slide door 3 unintended by the passenger during traveling of the vehicle.

Further, at step #04, if it is found that the slide door 3 is not fully closed (step #04: No), the process checks whether the power supply to the opening/closing body controlling apparatus 100 was interrupted or not. If the power was not interrupted (step #13: No), the process returns to step #04 to continue the operation. On the other hand, if the power was interrupted (step #13: Yes), the process continues the operation from step #05.

Returning to step #01, if it is found that power reactivation to the inventive opening/closing controlling apparatus 100 took place (step #01: Yes), the process checks whether the relationship between the striker 2 and the latch 41 is under the half latch condition or not. This checking is effected based on whether the half latch switch 81 has been changed from High (ON) to Low (OFF) or not. Upon detection of the half latch condition (step #07: Yes), the motor 61 is driven forwardly to start a latch closing operation (step #03), and the process effects the operations from step #04.

On the other hand, at step #07, if the half latch condition is not detected (step #07: No), then, the process checks the current position of the sector gear 63. Here, the current position of the sector gear 63 is identified by the displacement body position evaluating section 93. Alternatively, this position can be identified, based on the first detection signal from the neutral detecting first switch 84 and the second detection signal from the neutral detecting second switch 85.

That is, as shown in FIG. 7, if the first detection signal of the neutral detecting first switch 84 is High (ON) and the second detection signal of the neutral detecting second switch 85 is Low (OFF), it may be determined that the sector gear 63 is currently present in the closing region or the first boundary portion. Further, if the first detection signal of the neutral detecting first switch 84 is Low (OFF) and the second detection signal of the neutral detecting second switch 85 is High (ON), it may be determined that the sector gear 63 is currently present in the neutral region. Moreover, if the first detection signal of the neutral detecting first switch 84 is Low (OFF) and the second detection signal of the neutral detecting second switch 85 is High (ON), it may be determined that the sector gear 63 is currently present in the releasing region or the second boundary portion. In this way, the current position of the sector gear 63 is identified.

If the sector gear 63 is currently present in the releasing region or the second boundary portion (step #08: Yes), the process effects a second returning movement for returning the sector gear 63 to the second neutral position (step #09) and completes the operation. On the other hand, if the sector gear 63 is currently present in the neutral region, excluding the first boundary portion and the second boundary portion (step #10: Yes) or present in the closing region or the first boundary portion (step #12: Yes), the current position of the sector gear 63 is maintained (step #11) and the process is completed. Further, if the sector gear 63 is not currently present in the neutral region, excluding the first and second boundary portions thereof (step #10: No) and not present in the closing region or the first boundary portion (step #12: No), the process returns to step #07 to continue the operations. In accordance with the flowchart described above, the opening/closing body controlling apparatus 100 effects the operations.

OTHER EMBODIMENTS

In the foregoing embodiment, the opening/closing body controlled by the inventive opening/closing body controlling apparatus 100 has been described as a slide door 3 mounted in a vehicle. However, the applicable scope of the present invention is not limited thereto. The opening/closing body can be a tailgate door included in a vehicle or any other door, as a matter of course. Moreover, the opening/closing body is not limited to such vehicle doors, but can be a door in a building or the like, as a matter of course.

In the foregoing embodiment, the door opening/closing mechanism 40 is provided on the slide door 3 side whereas the striker 2 is provided on the vehicle body 1 side. However, the applicable scope of the present invention is not limited thereto. It is also possible to provide the door opening/closing operation mechanism 40 on the vehicle body 1 side and to provide the striker 2 on the slide door 3 side, as a matter of course.

In the foregoing embodiment, it has been described that the control unit 90 brings the latch 41 into contact with the pawl 42 restricting pivotal movement of this latch 41 in case the switchover information storing section 96 is not storing any switchover information that was stored in the course of a latch closing movement leading to a neutral returning movement. However, the application of the present invention is not limited thereto. Namely, precision position identification of the sector gear 63 is not possible also when the first detection signal was not outputted due to e.g. a certain trouble in the neutral detecting first switch 84 and the switchover information originally stored in the switchover information storing section 96 was not updated. In such case too, the latch 41 may be subjected to a stress. Therefore, the control unit 90 can be configured to effect the stress alleviating movement without effecting the first returning movement, in such case also.

INDUSTRIAL APPLICABILITY

The present invention is applicable to an opening/closing body controlling apparatus capable of a latch closing operation for establishing engagement between a latch and a striker and a latch releasing operation for releasing the engagement between the latch and the striker, through pivotal displacement based on motor operation.

The invention claimed is:

1. An apparatus for controlling an opening/closing body for automatically opening/closing the opening/closing body, the apparatus comprising:

a latch for drawing in and releasing a striker;

a displacement body for operating said latch via a latch operating mechanism, said displacement body being movable and displaced between movable regions including a latch closing region for drawing in said latch, a latch releasing region for releasing said latch and a neutral region located between said latch closing region and said latch releasing region;

a detecting section configured to output a detection signal in response to passage of the displacement body through a boundary portion of the neutral region on the side of the closing region;

a control unit which, when effecting a neutral returning movement for returning the displacement body from the closing region to the neutral region, stores switchover information indicative of switchover of the detection signal detected in the course of the latch closing movement and to effect the neutral returning movement in accordance with the switchover information; and wherein said displacement body is controlled to operate the latch operating mechanism to pivot said latch toward a pawl that restricts pivotal movement of said latch after the latch closing movement of said displacement body.

2. The opening/closing body controlling apparatus according to claim 1, wherein in effecting said neutral returning movement, in the case of presence of power reactivation during a period from the previous neutral returning movement to the current neutral returning movement, said control unit refers to switchover information that was stored at the time of the latch closing movement effected prior to the previous neutral returning movement; and in the case of absence of power reactivation during said period from the previous neutral returning movement to the current neutral returning movement, said control unit refers to switchover information that was stored at the time of the latch closing movement effected prior to the current neutral returning movement.

3. The opening/closing body controlling apparatus according to claim 1, wherein the controlling of the pivotal movement of the displacement body toward the pawl is effected until lapse of a predetermined period that is predetermined to be shorter than a period required for the displacement body to reach the neutral region after start of this controlling or by a predetermined movement amount that is predetermined to be smaller than a movement amount required for the displacement body to reach the neutral region after start of said controlling.

4. The opening/closing body controlling apparatus according to claim 1, wherein said opening/closing body controlling apparatus is used as a vehicle opening/closing body controlling apparatus to be mounted on a vehicle, and said control unit is configured not to effect the neutral returning movement according to said switchover information during traveling of the vehicle, even if a condition for effecting the neutral returning movement is established according to said switchover information.

* * * * *